US007542694B2

(12) United States Patent
Hisakuni

(10) Patent No.: US 7,542,694 B2
(45) Date of Patent: Jun. 2, 2009

(54) IMAGE FORMING METHOD WITH IMAGE FLOW SUPPRESSION FEATURE

(75) Inventor: Hisataka Hisakuni, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 133 days.

(21) Appl. No.: 11/682,019

(22) Filed: Mar. 5, 2007

(65) Prior Publication Data

US 2007/0212082 A1 Sep. 13, 2007

(30) Foreign Application Priority Data

Mar. 9, 2006 (JP) ..... 2006-064780

(51) Int. Cl.
*G03G 15/00* (2006.01)
*G03G 21/00* (2006.01)

(52) U.S. Cl. ..... 399/71; 399/75; 399/343

(58) Field of Classification Search ..... 399/71, 399/75, 343, 349, 43
See application file for complete search history.

(56) References Cited

U.S. PATENT DOCUMENTS 6,081,679 A * 6/2000 Yamane et al. ..... 399/71
6,847,797 B2 1/2005 Nishihama et al. ..... 399/174
6,963,703 B2 11/2005 Hisakuni ..... 399/71
6,963,709 B2 11/2005 Nishihama et al. ..... 399/174
7,024,127 B2 4/2006 Hisakuni ..... 399/71
2002/0141771 A1* 10/2002 Nishimura ..... 399/71 X

FOREIGN PATENT DOCUMENTS

| | | |
|---|---|---|
| JP | 2-44388 | 2/1990 |
| JP | 7-234619 | 9/1995 |
| JP | 9-319100 | 12/1997 |
| JP | 2000-19921 | 1/2000 |
| JP | 2000-132070 | 5/2000 |

OTHER PUBLICATIONS

Machine translation of JP 2000-019921 A dated Sep. 18, 2008.*
English-language computer translation of JP 2000-019921 A.

* cited by examiner

*Primary Examiner*—Sophia S Chen
(74) *Attorney, Agent, or Firm*—Fitzpatrick, Cella, Harper & Scinto

(57) ABSTRACT

A band-like developer (toner) image is formed on an image bearing member by a developing member without performing a charging operation by a charger for electrically charging the image bearing member and then is removed by a cleaner. Thereafter, the charging operation is started after an area, in which the band-like developer image is removed by the cleaner, passes through an opposing portion between the image bearing member and the charger.

7 Claims, 9 Drawing Sheets

IMAGE FORMING METHOD WITH IMAGE FLOW SUPPRESSION FEATURE

FIELD OF THE INVENTION AND RELATED ART

The present invention relates to an image forming method, particularly a constitution for preventing an occurrence of image flow.

In a conventional image forming apparatus such as a printer, a copying machine, a facsimile apparatus, etc., image formation is performed by disposing a charging means, an exposure means, a developing means, a transfer means, and a cleaning means at positions each adapted to an associated step. During the image formation, first, an image bearing member is electrically charged uniformly in the dark by the charging means (in a charging step).

When a charging (discharging) operation is effected by the charging means or the like, a discharge product such as nitrogen oxide or the like is generated and deposited on a surface of the image bearing member in some cases. The surface of the image bearing member has a surface resistance higher than that of water, so that electric charges on the image bearing member surface are held by charging and then removed on the basis of a photoconductive characteristic by light exposure. As a result, an electrostatic latent image is formed at the image bearing member surface.

However, when the discharge product is deposited no the surface of the image bearing member, the discharge product has a high moisture adsorptive property, so that moisture is attached to the image bearing member surface to lower a surface resistance correspondingly. As a result, a potential gradient of the electrostatic latent image cannot be maintained. For this reason, when the image bearing member is used for a long term, the electrostatic latent image in the form of thin lines or minute dots is caused to flow in a direction of the image bearing member surface. As a result, image flow which is a phenomenon such that the electrostatic latent image has already blurred before development is caused to occur.

As the image flow, there has been known image flow (flow by standing) occurring by leaving the image forming apparatus standing for a long period of time, after completion of an image forming operation, e.g., during the night. This image flow is caused due to deposition of a large amount of discharge product, generated in the neighborhood of a discharge mechanism such as a primary charger or the like after the image forming operation is completed, at an opposing portion between the image bearing member and the discharge mechanism which are placed in a stopped state. An image is caused to blur only at the opposing portion, e.g., immediately after power of a main assembly of the image forming apparatus is turned on.

In order to prevent such image flow, e.g., Japanese Laid-Open Patent Application (JP-A) Hei 9-319100 and JP-A 2000-132070 have proposed a method of removing moisture by heating an image bearing member.

However, in such a moisture removal method in which moisture adsorbed at the surface of the image bearing member is removed by heating, a temperature is required to be changed, so that it takes a time. Further, a large amount of electric power energy is consumed in the case of quick heating. In recent years, quick start of the apparatus after power is turned on is an important factor as a product performance. In addition, also from the viewpoint of energy saving, a quick elimination mode is required with respect to image flow caused by standing. Further, with a reduction in warm-up time of a fixing apparatus by progress of a fixing means such as an electromagnetic induction heating means, a reduction in sequence for eliminating the image flow has also been studied on a priority basis.

JP-A Hei 7-234619 has proposed, as a method not using a heating means, such a constitution that a surface of an image bearing member is rubbed by rotating the image bearing member for a predetermined time while causing a cleaning means to contact the image bearing member after the image forming apparatus is left standing and power is turned on and before an image forming operation is performed.

As described in JP-A Hei 7-234619, it is possible to alleviate the image flow phenomenon, particularly the above described standing flow phenomenon to some extent by rubbing the image bearing member surface with a cleaning blade provided to the cleaning means during image formation. However, in the case where a degree of deterioration is large, e.g., in the case of a large amount of surface deposit, the surface deposit cannot be removed by a rubbing member such as the cleaning blade. In addition, the surface deposit is extended along the surface of the image bearing member.

JP-A Hei 2-44388 and JP-A 2000-19921 have proposed a polishing mode in which a toner band (a layer of belt-like toner) is formed on an image bearing member and supplied to a cleaning portion, without being transferred, so as to polish the image bearing member surface with toner particles to improve a polishing/rubbing function.

However, in the case of employing such a polishing mode as described in JP-A Hei 2-44388 and JP-A 2000-19921, it has been formed that the polishing mode was accompanied with the following problem. More specifically, when a charger is actuated (a charging bias is applied) before or during running of an image forming apparatus in the polishing mode, a discharge product deposited on the surface of the image bearing member (photosensitive drum) is activated and liable to adsorb moisture. The moisture-adsorbing photosensitive drum becomes viscous, thus being less liable to be removed.

SUMMARY OF THE INVENTION

In view of the circumstances described above, the present invention has been accomplished.

A principal object of the present invention is to provide an image forming method capable of suppressing an occurrence of image flow in a short time by efficiently removing a discharge product while suppressing activation of the discharge product caused by actuation of a charger.

According to an aspect of the present invention, there is provided an image forming method comprising:

electrically charging an image bearing member by charging means;

forming a latent image on the image bearing member electrically charged by the charging means;

developing the latent image with a developer;

transferring a developer image onto a recording material by transfer means;

removing a residual developer remaining on the image bearing member by cleaning means contacting the image bearing member;

forming a removal developer image for being supplied to the cleaning means on the image bearing member after power of an image forming apparatus is turned on and before a charging operation by the charging means is performed; and starting the charging operation by the charging means after a leading end of an area, in which the removal developer image is removed by the cleaning means, passes through at least an opposing portion between the image bearing member and the charging means.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, embodiments of the present invention will be described more specifically with reference to the drawings.

Figure 1:
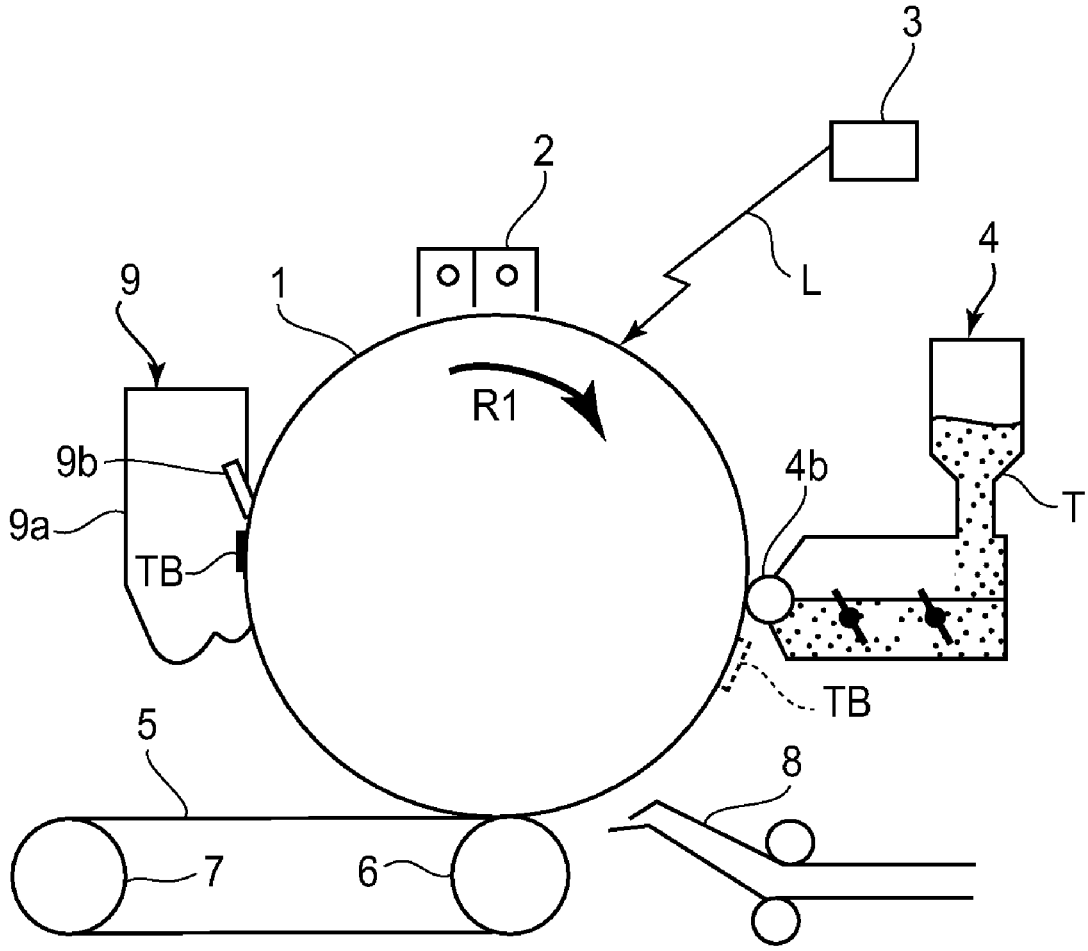
FIG. 1 is a schematic view for illustrating an inside of an image forming apparatus used in First Embodiment of the present invention.
Figure 2:
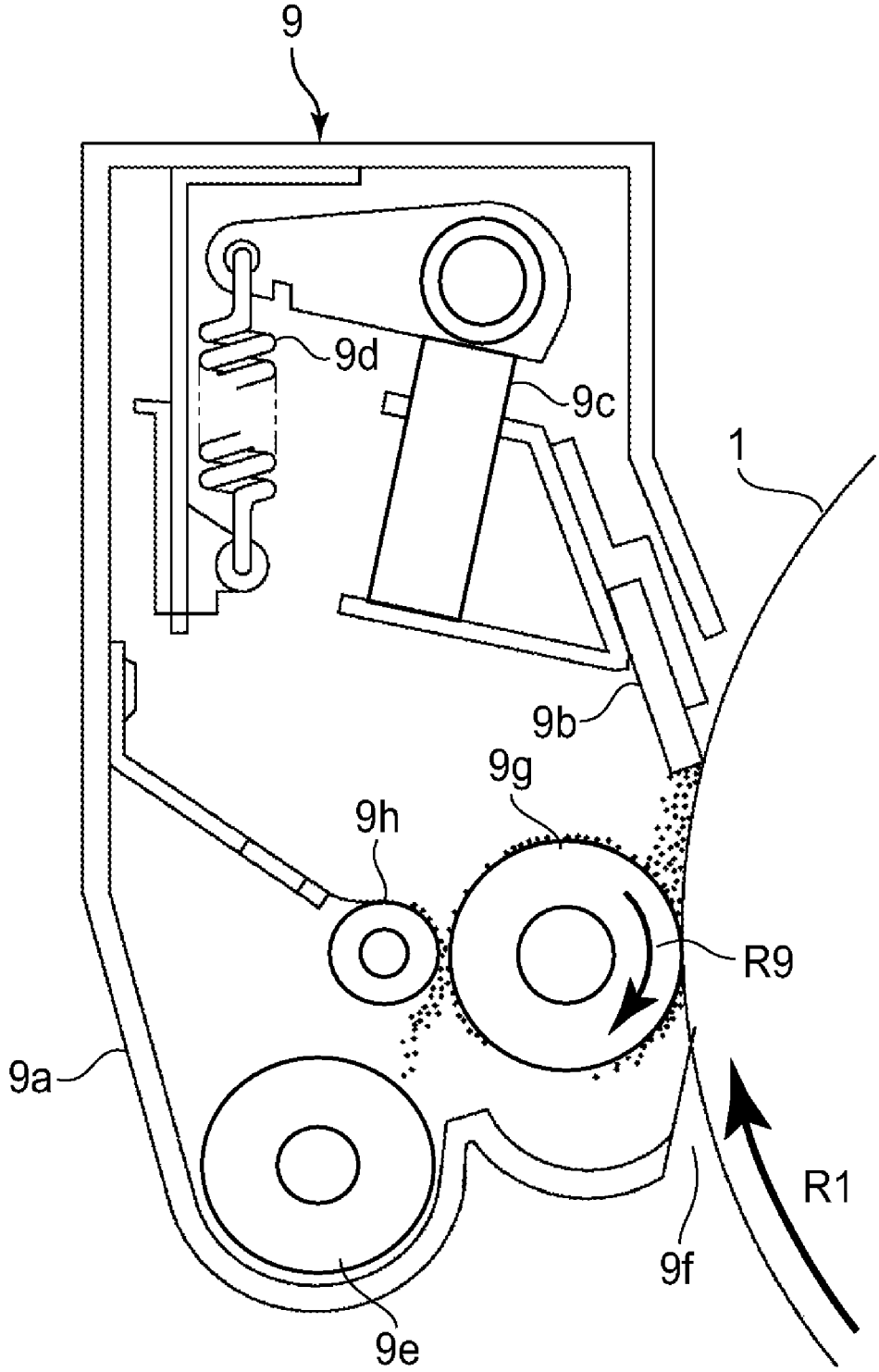
FIG. 2 is a schematic view for illustrating a cleaning apparatus provided to the image forming apparatus.

FIG. 1 is a schematic view showing an inside of an image forming apparatus used in First Embodiment of the present invention.

The image forming apparatus shown in FIG. 1 is an image forming apparatus, such as a copying machine, for forming an image according to an electrophotographic process. More specifically, the image forming apparatus forms a toner image on a sheet, such as paper, as a recording medium in accordance with an image signal sent from an unshown computer, etc.

The image forming apparatus includes a drum-type electrophotographic photosensitive member 1 as an image bearing member (hereinafter referred to as a "photosensitive drum"). The photosensitive drum 1 is rotationally driven in a direction of an indicated arrow R1 (clockwise direction in FIG. 1) at a predetermined process speed (peripheral speed) by an unshown drive means, so that a surface of the photosensitive drum 1 is electrically charged uniformly to a predetermined polarity and a predetermined potential by a primary charger (charging means) 2.

The photosensitive drum 1 after the charging is exposed to light L emitted by an exposure device (exposure means), 3 such as a laser oscillator or the like, emitting light on the basis of an image signal. As a result, electric charges at an exposed portion are removed to form an electrostatic latent image. The electrostatic latent image is developed as a toner image by attaching thereto toner T as a developing agent by means of a developing device (developing) means.

The sheet is supplied through conveyance path 8 to a transfer portion between the photosensitive drum 1 and a transfer roller (transfer means) 6 in synchronism with the toner image on the photosensitive drum 1. At the transfer portion, the toner image formed on the surface of the photosensitive drum 1 by the developing device 4 is transferred onto the sheet.

The sheet onto which the toner image is transferred is sent to an unshown fixing device (fixing means) by a conveyance belt 5 supported by transfer rollers 6 and 7. The toner image is fixed on the surface of the sheet by being heated and pressed by the fixing device. Thereafter, the sheet is discharged (outputted). Transfer residual toner remaining on the surface of the photosensitive drum 1 after the toner image transfer is removed by a cleaning apparatus (cleaning means) 9, so that the photosensitive drum 1 is subjected to subsequent image formation.

The photosensitive drum 1 used in this embodiment is an image bearing member of amorphous silicon (a-Si). The a-Si image bearing member is ordinarily constituted by forming an electroconductive layer of a-Si on an electroconductive support by a film-forming method such as vacuum (vapor) deposition, sputtering, or plasma CVD while heating the electroconductive support at 50-400° C. In this embodiment, the image bearing member is constituted by the plasma CVD, i.e., a method in which a source gas is decomposed by DC or high-frequency wave, microwave, or glow discharge to form an a-Si film on a support.

The toner is constituted by a core containing ester wax, a resin layer of styrene-butyl acrylate copolymer, and a surface layer of styrene-polyester resin and is prepared through suspension polymerization. In this embodiment, the thus prepared toner and a resinous magnetic carrier prepared through a polymerization method are mixed and used as a two-component developer.

Further, in this embodiment, a cleaning aid is added as an external additive to the two-component developer. The cleaning aid is prepared by pulverizing strontium titanate, classifying the pulverized product into particles of an average particle size of 0.1-3.0 μm, and externally adding the classified particles into the toner at a mixing ratio of 3.0 wt. %. When the cleaning aid has a Mohs hardness of 6.0 or more, the cleaning and also functions as an abrasive for rubbing or polishing the surface of the photosensitive drum 1.

Instead of the particles of strontium titanate as the cleaning aid, it is also possible to use fine powders of silicone oxide, aluminum oxide, titanium oxide, cerium oxide, germanium oxide, zinc oxide, tin oxide, zirconium oxide, molybdenum oxide, tungsten oxide, strontium oxide, boron oxide, silicon nitride, calcium titanate, magnesium titanate, phosphotungstic acid, phosphomolybdic acid, calcium carbonate, magnesium carbonate, aluminum carbonate, etc.

The cleaning apparatus 9 includes, in addition to the cleaning blade 9*b* shown in FIG. 1, a fur brush 9*g* of electroconductive nylon fibers as an auxiliary cleaning member at a position after the transfer in a rotation direction R9 of the photosensitive drum 1. The fur brush 9*g* is rotatably disposed and rotated at a peripheral speed which is 20% of that of the photosensitive drum 1 in a direction opposite to that of the photosensitive drum 1 in order to improve a rubbing (polishing) effect of the photosensitive drum 1 surface.

Against the fur brush 9*g*, a scraper 9*h* is abutted so as to discharge an excessive amount of toner deposited in the fur brush 9*g*.

The cleaning blade 9*b* is abutted against the photosensitive drum 1 at a position downstream from the fur brush 9*g* in the photosensitive drum 1 rotation direction while extending in a direction opposite to the photosensitive drum 1 rotation direction. At a lower portion of a casing 9*a* of the cleaning apparatus 9, a scooping sheet 9*f* is attached so that the toner scraped from the photosensitive drum 1 surface by the cleaning blade 9*b* is prevented from returning to the photosensitive drum 1 in a large amount.

Further, at the lower portion of the casing 9*a*, a screw (conveyance means) 9*e* for conveying and discharging the transfer residual toner is disposed so as to convey the transfer residual toner dropped in the casing 9*a* in a direction perpendicular to the photosensitive drum 1 rotation direction to be discharged from the cleaning apparatus 9. By constituting the cleaning apparatus 9 as described above, the inside of the casing 9*a* is not blocked with the transfer residual toner.

A setting condition of the cleaning blade 9*b* with respect to the photosensitive drum 1 is an important factor for determining a cleaning performance. Examples of the setting condition may include an abutting (contact) pressure of the cleaning blade 9*b* against the photosensitive drum 1, an abutting angle, a free length, and a thickness of the cleaning blade 9*b*. In this embodiment, in order to stabilize the abutting pressure of the cleaning blade 9*b* against the photosensitive drum 1, a pressing method using a tension spring 9*d* is employed. The cleaning blade 9*b* is held by a holder 9*c* and is caused to abut against the photosensitive drum 1 by the tension spring 9*d* via the holder 9*c*.

In this embodiment, the abutting pressure of the cleaning blade 9*b* against the photosensitive drum 1 is 25 N/m, and the thickness of the cleaning blade 9*b* is 3 mm. Further, a length of protrusion of the cleaning blade 9*b* from the holder 9*c* is 5 mm. The cleaning blade 9*b* is formed of polyurethane rubber and has physical property values, as measured according to the test methods for vulcanized rubber (JIS), including A-hardness of 73 degrees and modulus of repulsion elasticity of 50%.

Figure 3:
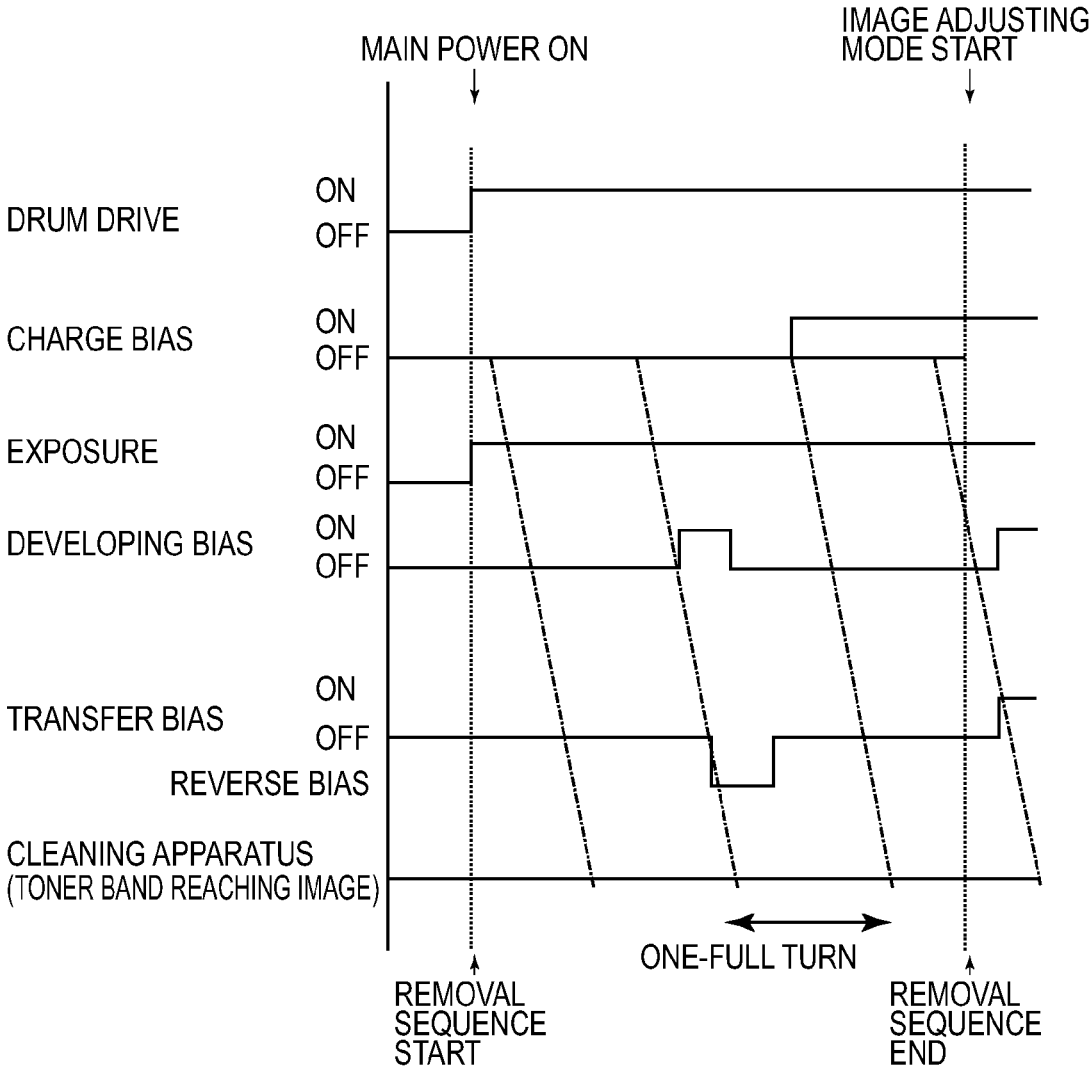
FIG. 3 is a time chart showing a sequence of a removal mode of a discharge product deposited on an image bearing member of the image forming apparatus.

FIG. 3 shows a removal sequence of deposit deposited on the photosensitive drum surface. In FIG. 3, an ordinate represents a time and an abscissa represents ON/OFF timing of photosensitive drum drive, charging bias, exposure, developing bias, and transfer bias. These abscissa values are positionally different in time, so that the abscissa is determined depending on a timing at which a particular position of the photosensitive drum passes through an associated member (means). This timing is indicated by chain lines alternate long and short dashed lines) for convenience of explanation.

The cleaning apparatus always abuts against the photosensitive drum, so that the particular position of the photosensitive drum passes through the respective means of charging, exposing, developing, and transferring and reaches the cleaning apparatus although these means are not actuated. In this case, at each of intersections between the chain lines and the respective ON/OFF timing lines, the particular position is located closest to an associated means. The photosensitive drum is repeatedly used, so that the chain lines are indicated at an interval corresponding to one full turn of the photosensitive drum. In other words, the respective processes for one image forming operation are performed at the interval (one full turn) and are repetitively effected.

Next, the photosensitive drum surface deposit removal sequence in this embodiment will be described. In this embodiment, this removal sequence is performed immediately after power is turned on.

When power of a main assembly of an image forming apparatus is turned on, drive of the photosensitive drum is started (ON). At the same timing, an exposure operation is also started (ON). However, this operation is performed in order to remove triboelectric charges generated by rubbing of the photosensitive drum 1 with abutting members (such as the cleaning blade) provided around the photosensitive drum 1.

In this embodiment, the exposure means is used for removing the triboelectric charges. However, in the case of an image forming apparatus including a pre-exposure means located upstream from the exposure means, the triboelectric charges may also be removed by the pre-exposure means.

Then, the developing bias is applied (ON) to a developing roller 4*b* of the developing device 4 shown in FIG. 1 so that only a developing operation is performed without effecting a charging operation. As a result, the photosensitive drum 1 is subjected to development only by the electric bias of the developing device 4. On the surface of the photosensitive drum 1 in a width direction perpendicular to the rotation direction of the photosensitive drum 1, a toner band TB which is a layer of uniform band-like developer (for removal mode) is formed in a toner coating area of the developing device 4 with a full width.

Next, the toner band TB formed on the photosensitive drum 1 in such a first step reaches the transfer portion by the rotation of the photosensitive drum 1. At the transfer portion, a transfer roller 6 is supplied with a current which has an opposite polarity to and an absolute value larger than that of a transfer bias during ordinary image formation.

As a result, a deposition force of the toner band TB with respect to the photosensitive drum 1 is increased. In this manner, by increasing the deposition force of the toner band TB with respect to the photosensitive drum 1 by applying the reverse bias to the transfer roller at the transfer portion, as described later, the toner is liable to enter a nip at the abutting portion of the cleaning blade to increase an effect of polishing and rubbing the photosensitive drum surface.

However, a magnitude of the reverse bias applied at the transfer portion is such a degree that the discharge product on the photosensitive drum is not activated. For this reason, as the transfer means, a contact-type transfer means causing less discharge, such as a transfer roller or the like, may preferably be used.

The toner band TB increased in deposition force with respect to the photosensitive drum 1 in such a second step described above is supplied to an abutting portion between the photosensitive drum 1 and a blade edge portion of the cleaning blade 9*b* and is scraped off the photosensitive drum 1 in a third step. In the third step, at the abutting portion between the cleaning blade 9*b* and the photosensitive drum 1, a rubbing effect by the toner is attained.

Particularly, in this embodiment, the toner (toner band) is strongly deposited no the photosensitive drum 1 at the transfer portion by the transfer means, so that toner particles increased in deposition force are liable to enter the abutting nip (portion) between the cleaning blade 9*b* and the photosensitive drum 1. As a result, the rubbing effect by the toner is enhanced. Accordingly, the abutting nip is an area in which the deposit is removed in a state in which the rubbing effect by the cleaning means is high. After a position of the photosensitive drum 1 at which the surface of the photosensitive drum 1 is cleaned by rubbing or polishing passes through a charge area of the primary charger, a primary charging operation which is a subsequent operation is performed.

The case where the primary charger is a corona charger using a scorotron method in this embodiment will be described.

Figure 8:
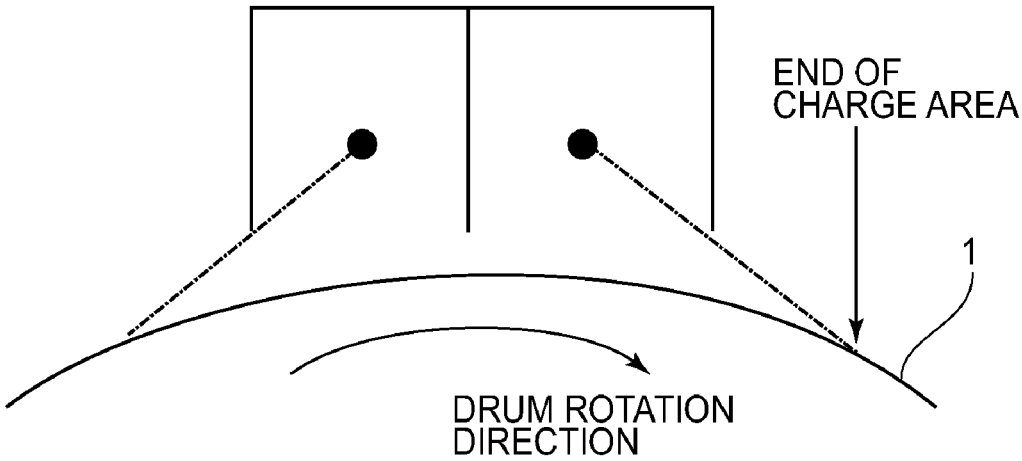
FIG. 8 is a schematic view for illustrating a charge area of a corona charger of a scorotron-type used as a primary charger of the image forming apparatus shown in FIG. 1.

In such a charging method, the charge area is an area between chain lines (straight lines) each connecting a charging wire and an extended portion on the photosensitive drum surface through an end of a shield portion as shown in FIG. 8. This is because corona ions are concentrically diffused and electrically charges the photosensitive drum. As shown in FIG. 8, after the polished (cleaned) portion of the photosensitive drum described above passes through an end point of the charge area, the primary charging operation may be performed. Further, in the case of the corona charger, the charge area may also be an area between two lines each extended vertically from the end of the shield portion to an associated portion on the surface of the photosensitive drum.

Figure 9:
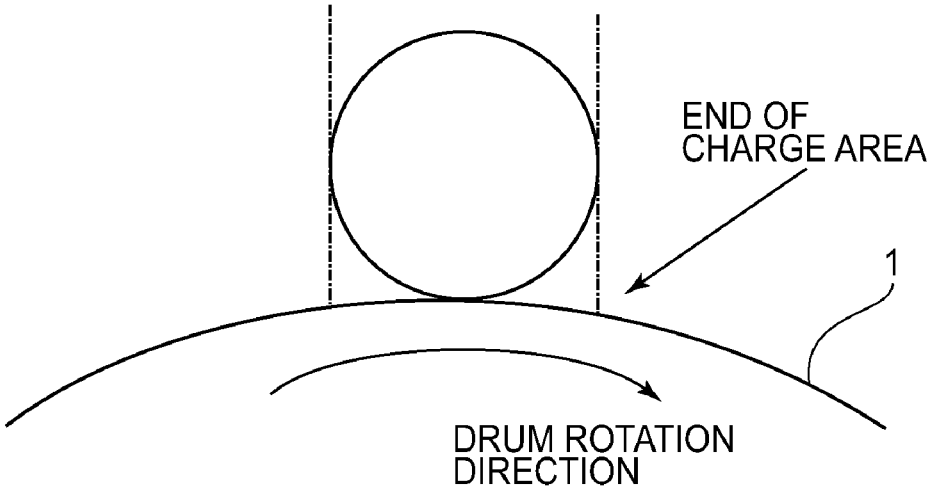
FIG. 9 is a schematic view for illustrating a charge area of roller-like charger of a contact charging-type used as a primary charger of the image forming apparatus shown in FIG. 1.

Further, as described in JP-A Hei 3-52058, in the case where a roller-type contact charging method is used as shown in FIG. 9, the charge area may be an area between chain lines having a width equal to a diameter of a charging roller. This is because the charge area in the case of the contact charging method varies depending on impedances or the like of the charging roller and the photosensitive drum but the contact charging method employs discharge with a minute gap, so that the area shown in FIG. 9 is sufficient as the charge area.

Figure 10:
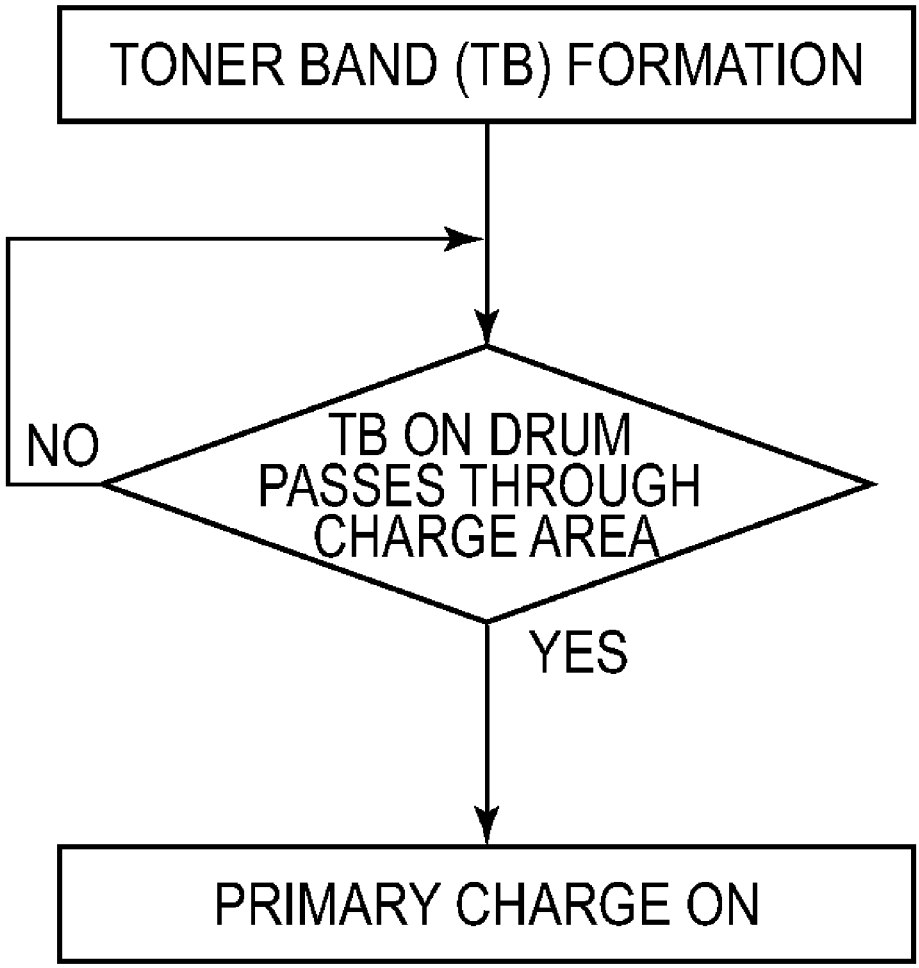
FIG. 10 is a flow chart for illustrating a primary charging operation in First Embodiment of the present invention.

FIG. 10 shows a flow chart of the primary charging operation in this embodiment. More specifically, as shown in FIG. 10, the primary charging operation is not started until the polished portion of the photosensitive drum passes through the charge area. In other words, after the polished portion passes through the charge area, the primary charging operation is performed.

As a specific embodiment of this embodiment, evaluation of an image was effected by using a copying machine (trade name: "GP605", mfd. by CANON KABUSHIKI KAISHA) remodeled so as to have the above described constitution. A photosensitive drum was used after subjected to image formation on $500\times10^4$ sheets. Confirmation of the image flow phenomenon was effected by using an image formed immediately after power was turned on after the copying machine was subjected to image formation on 5000 sheets, turned off, and left standing for 24 hours. As a result, the image was a good image free from the image flow.

In this embodiment, the rubbing effect by the toner is enhanced by applying the reverse bias at the transfer portion. However, in the present invention, the rubbing effect may also be increased by employing such a constitution that the transfer bias is not applied (OFF) or the transfer means is moved away from the photosensitive drum.

Next, comparative embodiments for this embodiment will be described.

Comparative Embodiment

In this comparative embodiment, as a sequence after the main power is turned on, a removal mode of deposit deposited on the photosensitive drum surface using the photosensitive drum surface deposit removal sequence is not effected but an image forming operation is performed after an image adjusting mode is effected. With respect to this comparative embodiment not employing the removal mode, evaluation of the image was effected in the same manner as in First Embodiment.

The image adjusting mode is such a mode that a charging condition or the like is adjusted by actuating a charger in advance of the image forming operation so as to obtain a predetermined charge potential.

As a result, a high-density line image having a width of about 200 μm could not be maintained and the resultant image was of such a poor level that a characteristic or the like was not recognizable. This is because moisture is adsorbed by photosensitive drum deposited on the photosensitive drum surface to lower a surface resistance of the photosensitive drum and thus an electrostatic latent image cannot be maintained to cause the image flow phenomenon.

Comparative Embodiment 2

In this comparative embodiment, the same removal mode as in First Embodiment was effected after an image adjusting mode performed after main power was turned on was completed. With respect to this comparative embodiment, the same evaluation as in First Embodiment was effected. As a result, the image flow causing the unrecognizable character at a level equal to that of Comparative Embodiment 1 was not caused to occur but a latent image of minute dots having a size of about 50 μm was caused to flow. Consequently, image failure such that a density of halftone image of the minute dots was decreased was caused to occur.

This is because in the case where the charging operation is performed before the removal mode is effected as in this comparative embodiment, the discharge product deposited on the photosensitive drum surface is activated to be liable to adsorb moisture, thus becoming viscous. In other words, in Comparative Embodiment 2, a removal ability of the deposit deposited on the photosensitive drum surface is higher than that in the case of Comparative Embodiment 1 but the photosensitive drum becomes viscous, so that the discharge product is less liable to be removed and a lowering in surface resistance of the photosensitive drum is somewhat caused to occur.

On the other hand, in the above described embodiment of the present invention, it is possible to efficiently remove the deposit deposited on the photosensitive drum surface by effecting the removal mode in which the toner band TB formed without performing the charging operation is deposited on the photosensitive drum 1 and then removed by the cleaning blade. As a result, the occurrence of image flow phenomenon caused by the lowering in surface resistance of the photosensitive drum can be suppressed.

According to this embodiment of the present invention, it is possible to efficiently remove the surface deposit causing the image flow phenomenon due to the lowering in surface resistance of the photosensitive drum by effecting the removal mode before the charging operation is performed. As a result, it is possible to prevent the image flow phenomenon in a short time, so that it is possible to not only prevent the image flow phenomenon even in a short adjusting time after power is turned on and before an image forming operation is performed but also stably obtain a good image for a long period of time without shortening the life span of the photosensitive drum.

The above described removal mode is not necessarily performed at all times. For example, the removal mode may also be performed selectively depending on usage history of the photosensitive drum or temperature and humidity at power-on of the main assembly of the image forming apparatus. This is because the image flow phenomenon is caused due to the lowering in surface resistance by moisture adsorption of the discharge product deposited on the photosensitive drum as described above, so that the presence or the absence of the image flow is determined depending on, e.g., the usage history of the photosensitive drum affecting an amount of deposition of the discharge product. Further, the presence or the absence of the image flow is also determined depending on, e.g., a relative humidity, during image formation, which is an amount of ambient moisture around the photosensitive drum.

Therefore, by employing such a constitution that the removal mode is effected only under a condition causing the image flow phenomenon but is not effected under a condition not causing the image flow phenomenon, it is possible to realize a reduction in toner consumption and a quick start operation after power-on.

Next, Second Embodiment of the present invention in which the removal mode is selectively effected will be described.

Figure 4:
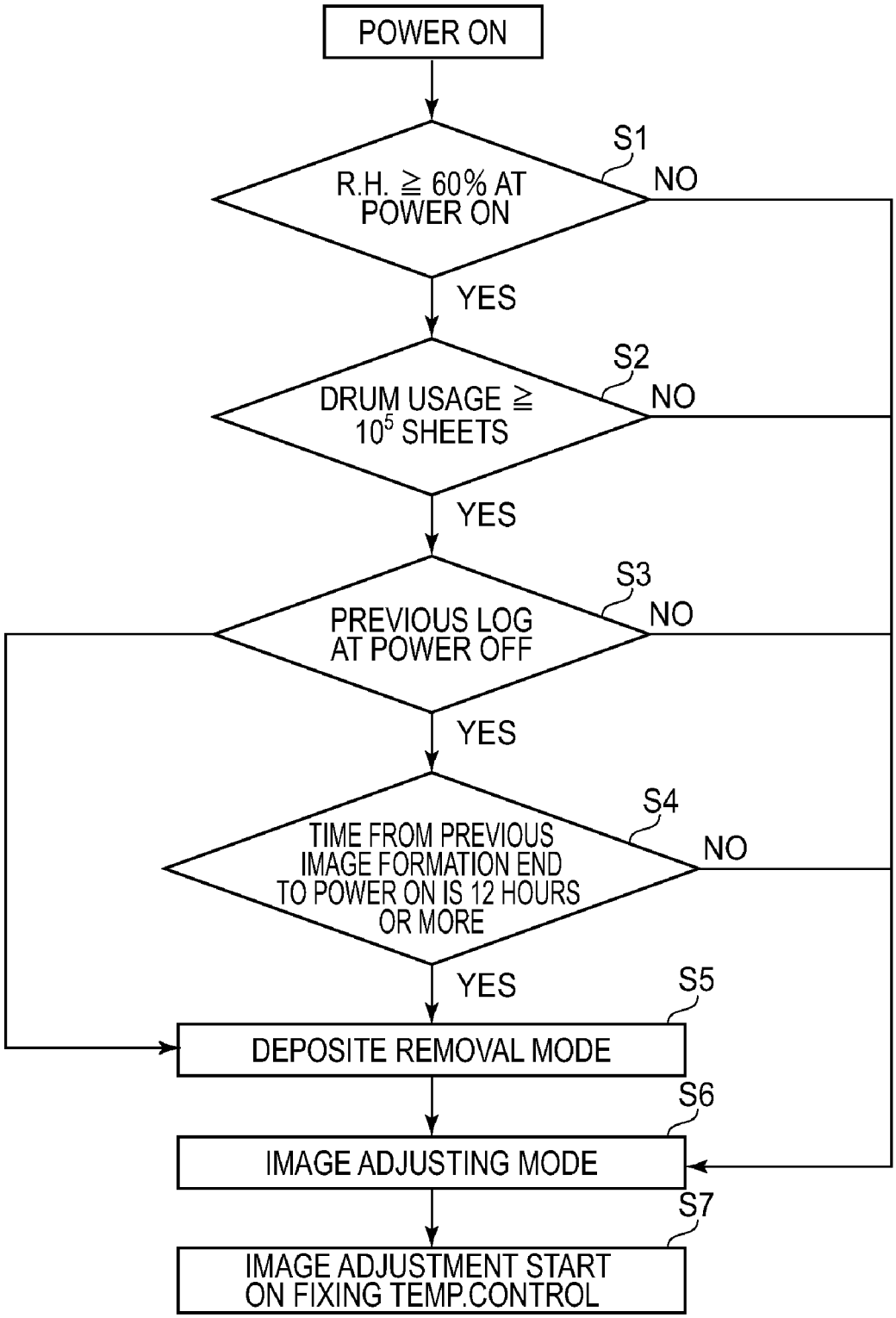
FIG. 4 is a flow chart for determining whether or not a removal mode is effected after power of an image forming apparatus including a cleaning apparatus used in Second Embodiment of the present invention.

FIG. 4 is a flow chart for determining whether or not the removal mode is effected after power of an image forming apparatus to this embodiment is turned on. This determination is performed by an unshown control means for controlling a toner band forming operation.

As described above, the image flow phenomenon by the surface deposit depends on an amount of moisture at the photosensitive drum surface carrying depending on the temperature and humidity during image formation and depends on the number of sheets of image formation by the photosensitive drum. Further, particularly, the image flow phenomenon by standing immediately after power is turned on depends on a standing time from power-off to subsequent power-on, the number of sheets of image formation by the photosensitive drum, and a temperature of the photosensitive drum at previous power-off.

In this embodiment, the removal mode is effected on the basis of a condition including a relative humidity during image formation of 60% or more, the number of sheets for image formation of $10\times10^4$ sheets as durability history of the photosensitive drum, and a time period from completion of (previous) image formation to (subsequent or current) power-on of 12 hours or more.

Referring to FIG. 4, the unshown control means determines whether or not the relative humidity during image formation is 60% or more (S1). In the case where the relative humidity is 60% or more (YES in S1), the control means determines whether or not the number of sheets for image formation is $10\times10^4$ sheets or more (S2). In the case where the number of sheets is $10\times10^4$ sheets or more (YES in S2), the control means determines whether or not there is a previous log at power-off (S3). In the case where there is the previous log (YES in S3), the control means determines whether or not the time period from the completion of image formation to power-on is 12 hours or more (S4). In the case where the time period is 12 hours or more (YES in S4), a removal mode of deposit deposited on the image bearing member (photosensitive drum) is performed (S5). Thereafter, an image adjusting mode is effected (S6), so that image adjustment is started as soon as fixing temperature control is completed (S7).

On the other hand, in the cases where the relative humidity is less than 60% (NO in S1), the number of sheets is less than $10\times10^4$ sheets (NO in S2), there is no previous log (NO in S3), or the time period is less than 12 hours (NO in S3), the image adjusting mode is performed (S6). Thereafter, the image adjustment is started as soon as fixing temperature control is completed (S7). By effecting the above described control, it is not required that an unnecessary removal mode is performed, so that it is possible to reduce an amount of toner consumed for toner band formation and an unnecessary time after power of the image forming apparatus main assembly is turned on.

Further, in a low-humidity environment in which an amount of toner charge is originally large, a deposition force of toner on the photosensitive drum is also large. When the toner deposition force is increased at the transfer portion, it is required that a pressure of the cleaning blade is increased in order to enhance the cleaning performance. Further, the increase in pressure of the cleaning blade can lead to accelerate a deterioration phenomenon of the cleaning blade or the photosensitive drum due to abrasion or wearing.

In this embodiment, however, the removal mode is not effected in the case of a low-humidity environment in which the relative humidity during image formation is less than 60%. As a result, the deterioration phenomenon of the cleaning blade or the photosensitive drum due to abrasion or wearing can be prevented.

Further, the level of image flow is charged with time depending on a durability level of the photosensitive drum, so that the control means changes a coverage of toner in the removal mode depending on the durability level of the photosensitive drum. As a result, it is possible to minimize the amount of toner consumed in the removal mode.

Further, in this embodiment, it is possible to most efficiently polish the photosensitive drum by providing an unshown storing means for storing information about a stop position of the photosensitive drum and adjusting a position of toner band to be formed in the removal mode to a position, of the charger in a stopping state, at which the discharge product is deposited on the photosensitive drum. Moreover, it is possible to minimize a rotation distance of toner band required after the toner band reaches the cleaning means.

Next, Third embodiment of the present invention will be described.

In this embodiment, during successive image formation, a toner band is formed in a charger-off state and at the same time, the toner band is supplied to the cleaning apparatus in a state in which a deposition force of the toner band with respected to the photosensitive drum is increased by applying a current in an opposite direction by the transfer means.

Figure 5:
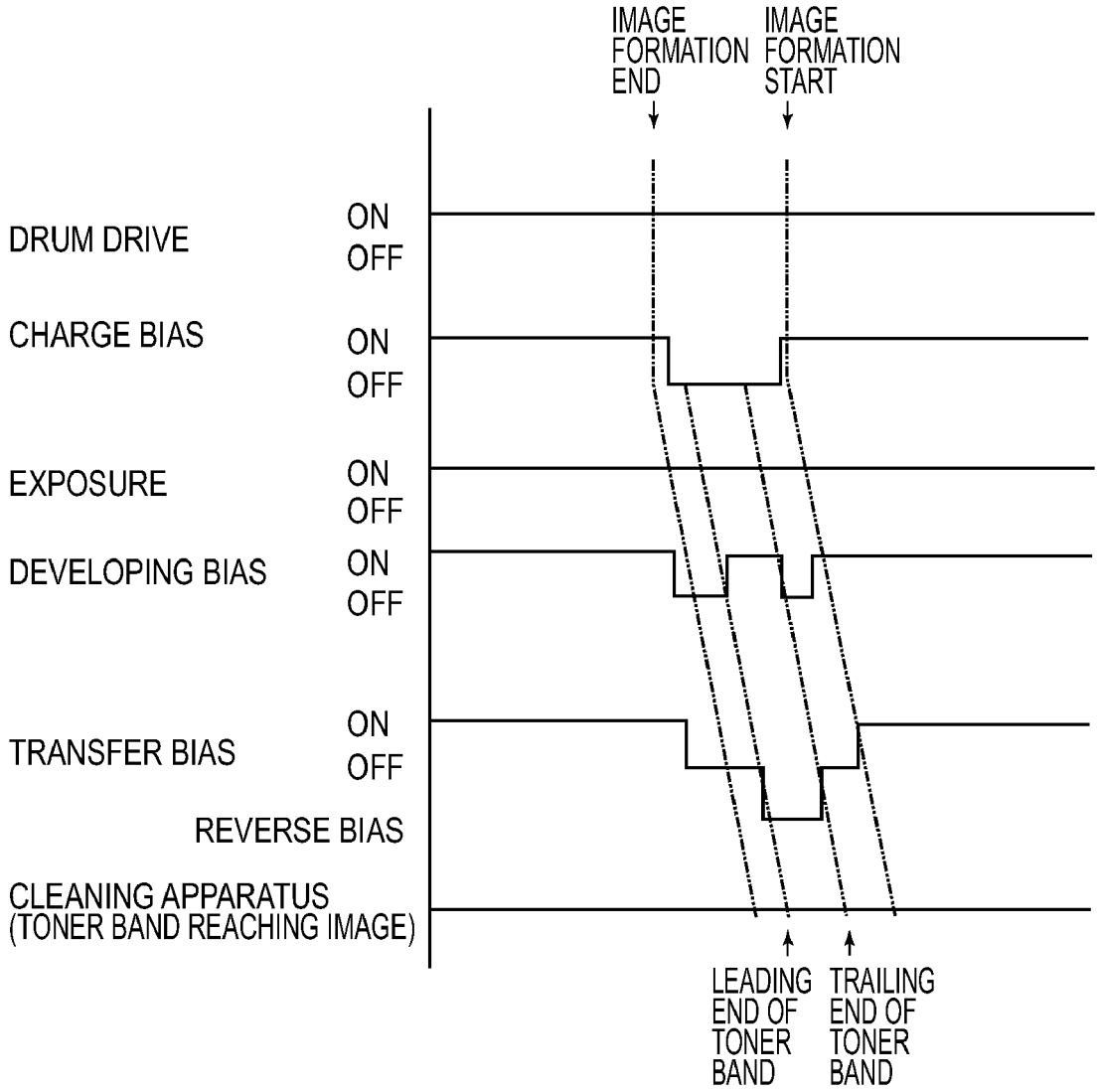
FIG. 5 is a time chart showing a sequence of a removal mode of a discharge product deposited on an image bearing member of an image forming apparatus including a cleaning apparatus used in Third Embodiment of the present invention.

FIG. 5 shows a removal sequence in such a removal mode.

In this embodiment, as shown in FIG. 5, at a sheet interval during image formation, i.e., in a period of time from end of image forming operation to start of (subsequent) image forming operation, the charger is turned off and the toner band is formed.

This sequence is performed at every sheet interval in the successive image formation under such a condition that the image flow is liable to occur as described in Second Embodiment.

Figure 6:
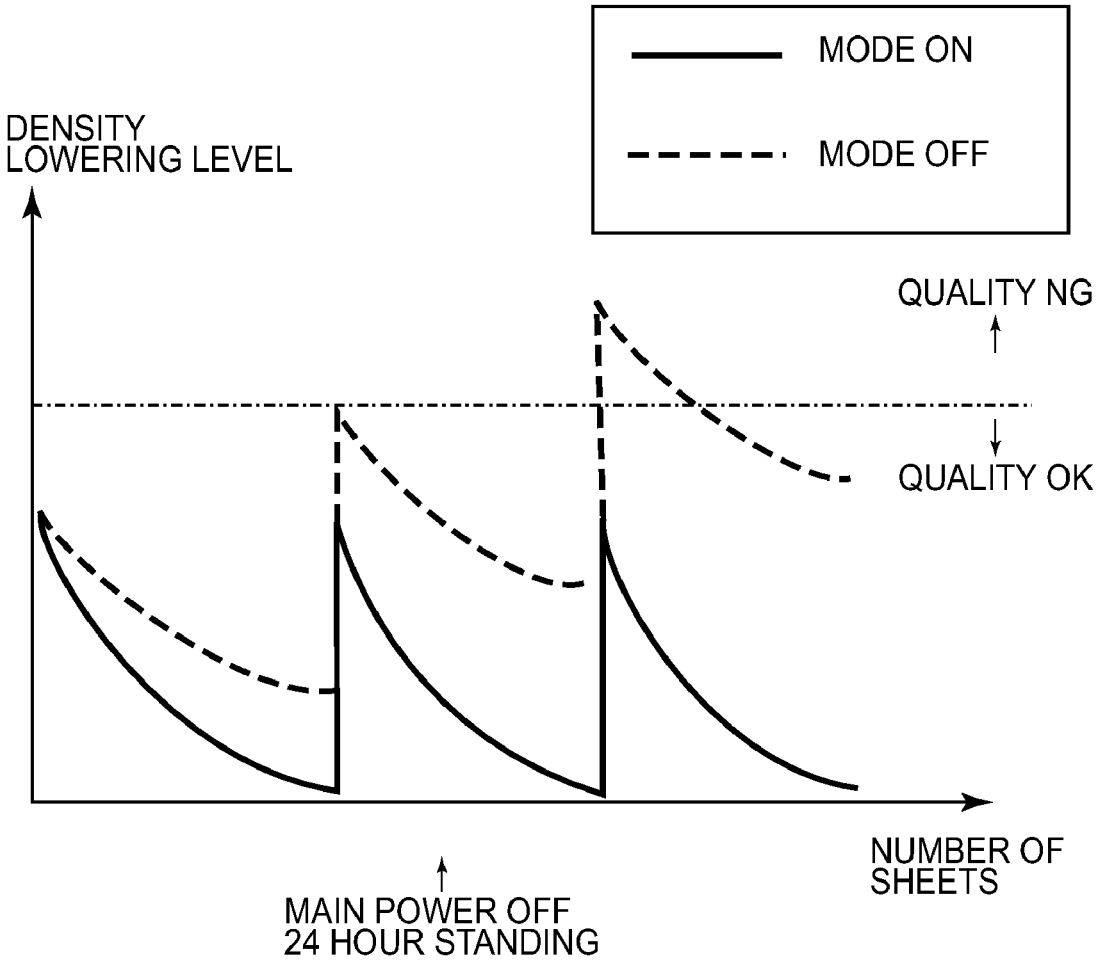
FIG. 6 is a graph showing a relationship between a number of sheets and an image density lowering level in the case of a discharge product removal mode and in the case where the discharge product removal mode is not effected.

FIG. 6 is a graph showing results of the cases where the above described sequence (removal mode) is performed and not performed by using a copying machine (trade name: "GP605", mfd. by CANON KABUSHIKI KAISHA) configured to perform the sequence.

The photosensitive drum was used after subjected to image formation of $500\times10^4$ sheets, and confirmation of the image flow phenomenon was effected in a constant temperature and humidity environment (30° C. and 80% RH). In an evaluation mode, image formation was successively performed on 1000 sheets and power of the main assembly of the copying machine was turned off. The copying machine was then left standing for 24 hours. Thereafter, the copying machine was repetitively subjected to image formation on 1000 sheets and left standing for 24 hours.

In FIG. 6, an abscissa represents an amount of decreased density (density lowering level), of a halftone image formed of minute dots, caused by the image flow. An ordinate represents the number of sheets for image formation. Further, a solid line represents the case where the mode in this embodiment is effected for each of sheet intervals (image formation intervals), and a broken line represents the case where the mode in this embodiment is not effected and the charging operation is performed even during the sheet intervals. The amounts of decreased density of the halftone image of minute dots are compared with respect to a dot size smaller than that of an actual product. For this reason, in FIG. 6, a chain line representing a quality borderline of a practical image is indicated.

In the case where, as in this embodiment, the charger is turned off at the sheet interval during image formation and the toner band is formed at the sheet interval, the image density lowering due to the image flow caused by the deposition of the discharge product cannot be eliminated. However, the mode in this embodiment is repetitively effected, whereby it is possible to remove the discharge product deposited on the surface of the photosensitive drum. Further, there is no deterioration of the photosensitive drum due to accumulation of the deposited discharge product, so that it is possible to maintain a good image forming state.

In this embodiment, it is not necessary to rotate the photosensitive drum through one full turn or more for one execution of the mode. Further, the sheet interval which is a time period between a cycle of image formation and a subsequent cycle of image formation occurs randomly, so that an area in which the removal mode is effected at the sheet interval extends on average over the entire area of the photosensitive drum by the image forming operation on 1000 sheets.

In the case where the removal mode is repeated, a removal ability of the discharge product deposited on the entire surface of the photosensitive drum is a circumferential direction is increased over time when the position of the toner band formed on the photosensitive drum surface shifts in a long period of time.

However, depending on the operation of the main assembly of the image forming apparatus, the sheet interval area can be localized at a portion of the entire area of the photosensitive drum surface. For this reason, in a preferred embodiment, in formation about the position of the toner band formed on the photosensitive drum surface is stored in an unshown storing means and the control means controls the toner band-formed position on the basis of the positional information stored in the storing means. As a result, it is possible to extend the removal mode-effected area over the entire area of the photosensitive drum surface on average by the mode in this embodiment performed a plurality of times.

Incidentally, in this embodiment, the mode of this embodiment is performed every sheet interval, so that the image adjustment cannot be performed by utilizing the sheet interval. However, similarly as in Second Embodiment, the sheet interval can be utilized for another adjusting mode by controlling whether or not the adjusting mode is performed.

Next, Fourth Embodiment of the present invention will be described.

Figure 7:
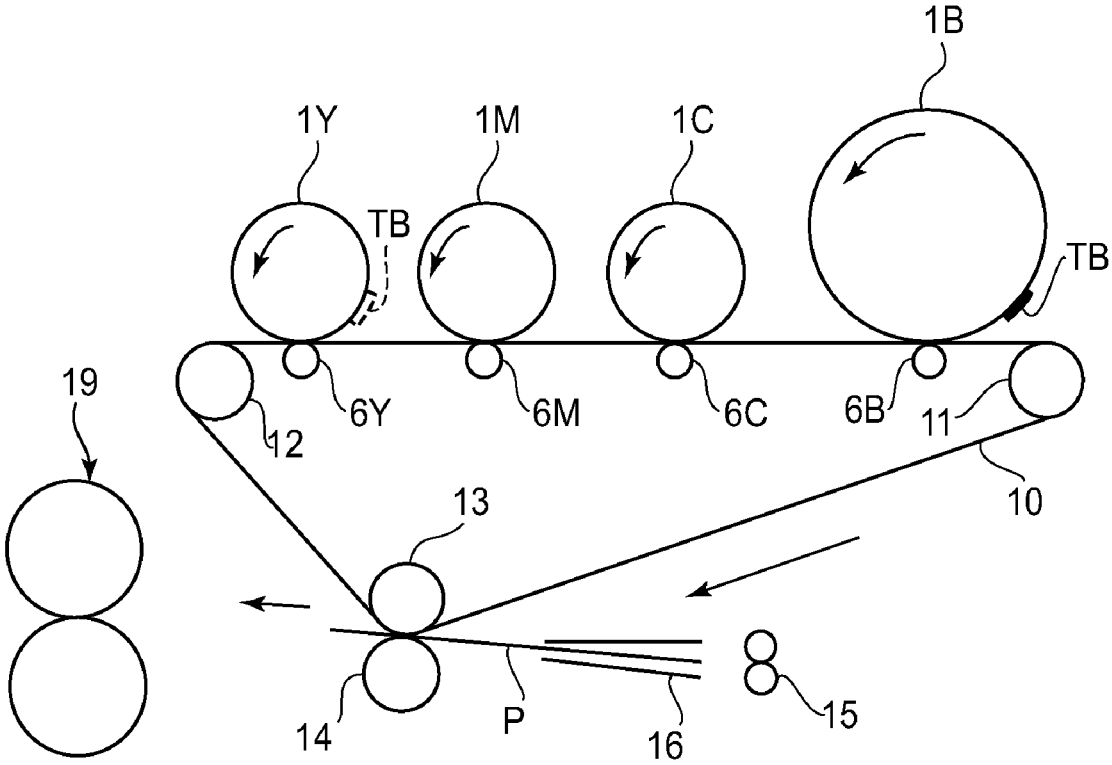
FIG. 7 is a schematic view for illustrating an image forming apparatus used in Fourth Embodiment of the present invention.

FIG. 7 is a schematic view showing a constitution of an image forming apparatus used in this embodiment. The image forming apparatus is an electrophotographic color image forming apparatus including first to fourth image forming portions, disposed in tandem, capable of forming visible images of, e.g., yellow (Y), magenta (M), cyan (C) and black (B).

Each of the image forming portions includes a drum-type photosensitive drum 1Y, 1M, 1C and 1B having an electroconductive layer. Around each photosensitive drum 1Y, 1M, 1C or 1B, in addition to a primary transfer means 6Y, 6M, 6C or 6B as a dedicated image forming means, unshown means including a charging means, an exposure means, a developing means, a cleaning means, and the like are disposed.

An intermediary transfer belt 10 as an intermediary transfer member is extended around three rollers including a drive roller 11, a tension roller 12, and a secondary transfer opposing roller 13. A secondary transfer roller 14 is disposed opposite to the secondary transfer opposing roller 13 via the intermediary transfer belt 10.

Toner images formed on the respective photosensitive drums 1Y, 1M, 1C and 1B are transferred onto the intermediary transfer belt 10 in a superposition manner by the respective primary transfer means 6Y, 6M, 6C and 6B. Thereafter, a sheet conveyed by rollers 15 through path 16 to a nip, where the resultant toner image is transferred onto a sheet P by a secondary transfer means constituted by the secondary transfer opposing roller 13 and the secondary transfer roller 14, and fixed on the surface of the sheet P by a fixing device 19, under heat and pressure. Thereafter, the toner image-fixed sheet P is discharged (outputted).

In this embodiment, immediately after power of the image forming apparatus is turned on, the first photosensitive drum 1Y is electrically charged and exposed to light by the exposure means so as to form an electrostatic latent image for forming a layer of toner band TB as a longitudinal band-like toner image, followed by development by the developing means to form the toner band.

The toner band formed on the first photosensitive drum 1Y is transferred onto the intermediary transfer belt by the first primary transfer means 6Y. Thereafter, the toner band on the intermediary transfer belt reaches, e.g., a primary transfer portion (primary transfer means 6B) of the fourth photosensitive drum 1B by the drive of the intermediary transfer belt 10.

At that time, the fourth primary transfer means 6B is supplied, by constant current control, with a current in a direction opposite from that of a current supplied during ordinary image formation. For this reason, the toner band TB on the intermediary transfer belt is transferred back onto the fourth photosensitive drum 1B. Thereafter, the toner band TB on the fourth photosensitive drum 1B is sent to a cleaning apparatus to be subjected to a removal mode on the fourth photosensitive drum 1B.

According to this embodiment, it is possible to strictly control an amount of toner by applying a current to the primary transfer means 6B of the fourth photosensitive drum 1B so as to have a desired value irrespective of an electric potential of the photosensitive drum.

As a result, compared with the above described image forming apparatuses in First to Third Embodiments in which the photosensitive drum potential is controlled only by the exposure operation without performing the charging operation, it is possible to setting electric potentials of the respective photosensitive drums 1Y, 1M, 1C and 1B. As a result, the amount of toner can be strictly adjusted. Further, the image forming apparatus of this embodiment has the advantage that it causes no carrier deposition by not driving the developing apparatus.

Further, a charge amount of the toner band TB used in the removal mode is increased by the transfer means or an unshown post-charger on the intermediary transfer belt or the photosensitive drums other than the fourth photosensitive drum 1B, so that it is also possible to further increase a deposition force of toner with respect to the fourth photosensitive drum 1B.

As described above, in the image forming apparatus of this embodiment, the toner band TB is formed by the photosensitive drum 1Y other than the fourth photosensitive drum 1B for carrying out the removal mode in a first step. Then, in a second step, the toner band TB is sent to the fourth photosensitive drum 1B for carrying out the removal mode via the intermediary transfer belt 10 and the primary transfer means 6Y, 6M, 6C and 6B.

As a result, it is possible to prevent deposition of developing carrier caused due to incapable detailed setting of charge potential by not controlling the charge potential when the toner band TB is formed without performing the charging operation as in First to Third Embodiments described above.

In this embodiment, description is made with respect to the case where the toner band TB formed on the first photosensitive drum 1Y is sent to the fourth photosensitive drum 1B. However, a combination of the photosensitive drums for forming and receiving the toner band TB is not limited to the combination of the first and fourth photosensitive drums 1Y and 1B.

As described hereinabove, according to the present invention, by not performing the charging operation by the charging means until the developer (toner) image is formed on the image bearing member and removed by the cleaning means, it is possible to efficiently remove the deposit deposited on the surface of the image bearing member. As a result, an occurrence of the image flow phenomenon caused due to a lowering in electric resistance at the surface of the image bearing member can be suppressed in a short time.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 064780/2006 filed Mar. 9, 2006, which is hereby incorporated by reference.

What is claimed is:

1. An image forming method using an image forming apparatus comprising a charging device for electrically charging an image bearing member, an exposure device for forming an electrostatic image on the image bearing member, a developing device for forming a toner image by developing the image bearing member, a transfer device for transferring the toner image from the image bearing member onto a recording material by being supplied with a transfer bias, and a cleaning device for cleaning the image bearing member by using a cleaning member contactable to the image bearing member, said image forming method comprising:

forming on the image bearing member a removal toner image to be supplied to the cleaning device without being subjected to a charging operation by the charging device after electric power of the image forming apparatus is turned on;

applying a bias of a polarity opposite to a polarity of the transfer bias to the transfer device when the removal toner image on the image bearing member passes through the transfer device; and starting the charging operation by the charging device after a leading end of an area, in which the removal toner image is removed by the cleaning device, passes through at least an opposing portion between the image bearing member and the charging device.

2. A method according to claim 1, wherein a current value for the bias of the opposite polarity is larger in terms of an absolute value than a current value of the transfer bias.

3. A method according to claim 1, wherein the charging device starts the charging operation after the removal developer image reaches the cleaning device and rubbing is effected through at least one full turn by the cleaning device with the removal developer image between the image bearing member and the cleaning device.

4. A method according to claim 1, wherein the removal developer image is formed in an area in which the image bearing member is electrically charged by the charging device.

5. A method according to claim 1, wherein the exposure device exposes the image bearing member to light and an electric charge at the surface of the image bearing member is removed in a removal mode.

6. A method according to claim 1, wherein a removal mode is selectively effected depending on usage history of the image bearing member or temperature and humidity at power-on of the image forming apparatus.

7. A method according to claim 6, wherein the usage history of the image bearing member is the number of sheets for image formation or a time period from a previous power-off of the image forming apparatus to a power-on of the image forming apparatus.

* * * * *